US009339150B1

(12) United States Patent
Risko

(10) Patent No.: US 9,339,150 B1
(45) Date of Patent: May 17, 2016

(54) SINK OVERFLOW PLUGS AND PLUNGER

(71) Applicant: Douglas L. Risko, Walled Lake, MI (US)

(72) Inventor: Douglas L. Risko, Walled Lake, MI (US)

( * ) Notice: Subject to any disclaimer, the term of this patent is extended or adjusted under 35 U.S.C. 154(b) by 266 days.

(21) Appl. No.: 13/962,466

(22) Filed: Aug. 8, 2013

Related U.S. Application Data

(60) Provisional application No. 61/813,799, filed on Apr. 19, 2013.

(51) Int. Cl.
*A47K 1/14* (2006.01)
*E03C 1/24* (2006.01)

(52) U.S. Cl.
CPC ..... *A47K 1/14* (2013.01); *E03C 2001/2413* (2013.01)

(58) Field of Classification Search
CPC ..... A47K 1/14; E03C 2001/2413
USPC ..... 4/293, 295, 694
See application file for complete search history.

(56) References Cited

U.S. PATENT DOCUMENTS

| | | | | | |
|---|---|---|---|---|---|
| 176,907 | A * | 5/1876 | Webb | 4/694 | |
| 206,210 | A * | 7/1878 | Allen | 4/694 | |
| 213,862 | A * | 4/1879 | Blunt | 4/694 | |
| 235,629 | A * | 12/1880 | Grows | E03C 1/242 | 4/669 |
| 246,973 | A * | 9/1881 | Persson | 4/293 | |
| 302,253 | A * | 7/1884 | Hoffman | 4/694 | |
| 321,504 | A * | 7/1885 | Jackson | 4/694 | |
| 1,825,499 | A * | 9/1931 | Zorn | 4/293 | |
| 4,683,597 | A | 8/1987 | Taylor, Jr. et al. | | |
| 5,184,698 | A | 2/1993 | Coffenberry | | |
| 5,273,077 | A * | 12/1993 | Oropallo | E03C 1/24 | 138/89 |
| 6,216,288 | B1 * | 4/2001 | Bernau | 4/694 | |
| 6,732,385 | B1 * | 5/2004 | Henderson et al. | 4/295 | |
| 2004/0143892 | A1 * | 7/2004 | Bantz | 4/295 | |
| 2008/0066222 | A1 | 3/2008 | Mooney | | |
| 2008/0276366 | A1 | 11/2008 | Bitowft | | |
| 2014/0223659 | A1 * | 8/2014 | Gay | E03C 1/244 | 4/694 |

* cited by examiner

*Primary Examiner* — J. Casimer Jacyna
(74) *Attorney, Agent, or Firm* — Robert C. Montgomery; Montgomery Patent & Design

(57) ABSTRACT

A sink overflow hole plug can include a plug body defining an interior chamber, and at least one protuberance extending into the chamber, wherein the protuberance is configured to be received by an external aperture of an overflow prevention channel of a drainage system of a plumbing fixture.

14 Claims, 4 Drawing Sheets

SINK OVERFLOW PLUGS AND PLUNGER

RELATED APPLICATIONS

The present invention was first described in and claims the benefit of U.S. Provisional Application No. 61/813,799, filed Apr. 19, 2013, the entire disclosures of which are incorporated herein by reference.

FIELD OF THE INVENTION

The present invention relates generally to sinks, and more particularly, to a plug for a sink overflow configured to block the flow of air when plunging a main drain.

BACKGROUND OF THE INVENTION

There is no other plumbing task more appalling than having to deal with clogged drain piping. Many people turn to the use of chemical drain cleaners, but such cleaners are hazardous to store, especially with children and pets around. They can also be dangerous to the piping and sink surfaces as well. Finally, they may pose environmental dangers as they are flushed out of the pipe, and onto wastewater treatment facilities.

Others turn to the use of mechanical systems, most commonly a plunger. While such plungers do a great job, they are somewhat ineffective on sinks with an overflow opening, such as a bathroom sink. This is because any positive or negative pressure generated by the plunger escapes out of the overflow, rather than being directed to the clog. Users often use rags or even their hands to cover the openings, but they are not completely airtight.

Accordingly, there exists a need for a means by which overflow openings in sink drains can be completely and securely covered, in order to prevent the problems as described above.

SUMMARY OF THE INVENTION

The inventor has recognized the aforementioned inherent problems and lack in the art and observed that there is a need for a device configured to completely and securely cover overflow openings on sink drains during plunging operations. The development of the present invention, which will be described in greater detail herein, substantially departs from conventional solutions to provide a sink overflow hole plug and in doing so fulfills this need.

In one (1) embodiment, the disclosed sink overflow hole plug can include a plug body defining an interior chamber, and at least one protuberance extending into the chamber, wherein the protuberance is configured to be received by an external aperture of an overflow prevention channel of a drainage system of a plumbing fixture.

In another embodiment, the disclosed sink overflow hole plug can include a plug body including a continuous sidewall including an upper perimeter edge and a lower perimeter edge and a diaphragm connected to the upper perimeter edge of the sidewall, the sidewall and the diaphragm defining an interior chamber, the lower perimeter edge of the sidewall being open to provide access to the chamber, and at least one protuberance extending from an interior surface of the diaphragm into said chamber, wherein the protuberance is configured to be received by an external aperture of an overflow prevention channel of a drainage system of a plumbing fixture.

Furthermore, the described features and advantages of the disclosed sink overflow hole plug can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
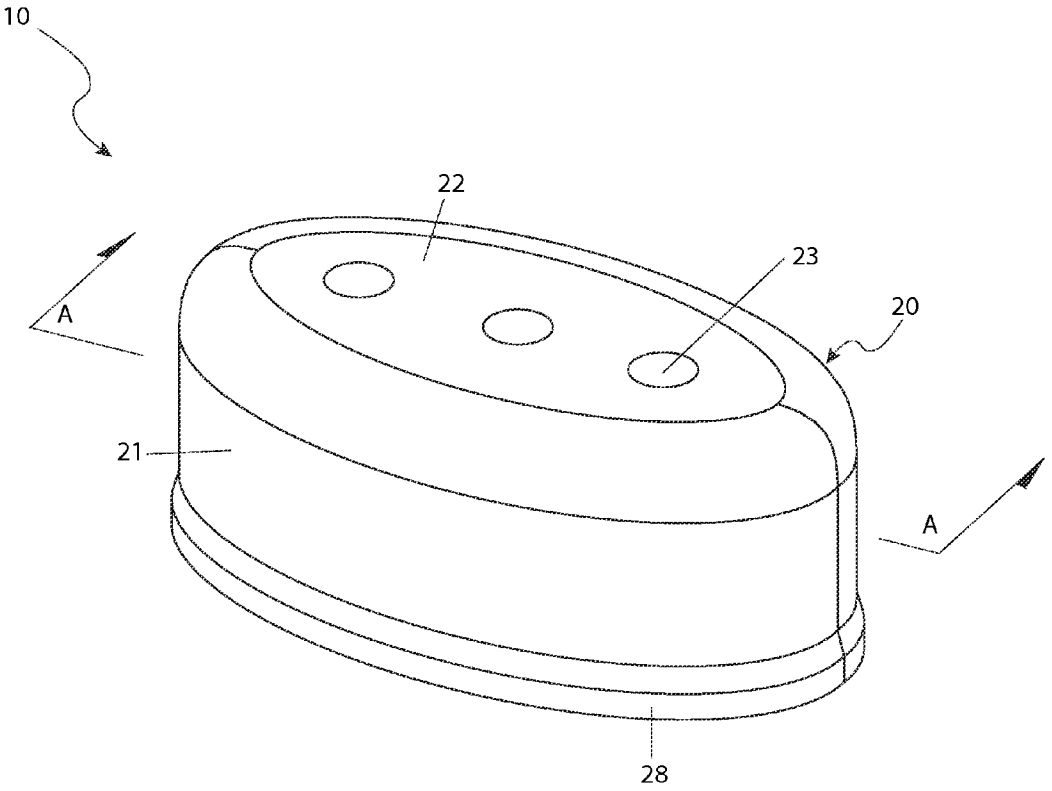
FIG. 1 is an front and side perspective view of one embodiment of the disclosed sink overflow hole plug in accordance with the present invention.

10 sink overflow hole plug
20 body
21 wall
22 diaphragm
23 indentation
24 chamber
26 protuberance
28 lip
29 groove
100 plumbing fixture
101 overflow prevention channel
102 external aperture

DETAILED DESCRIPTION OF THE PREFERRED EMBODIMENT

In accordance with the invention, the best mode is presented in terms of the described embodiments, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms “a”, “an” and “the” are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring to FIGS. 1-4, disclosing a sink overflow hole plug (herein referred to as the "device") 10, where like reference numerals represent similar or like parts. The device 10 can be configured to block the flow of water, air, or a combination of water and air through the external apertures 102 of the overflow prevention channel 101 of a plumbing fixture 100. The device 10 can be configured to seal the drainage system of the plumbing fixture 100 to bring about the effective exertion of force required to remove an artificial obstruction in the drainage system, such as during a plunging process.

Figure 2:
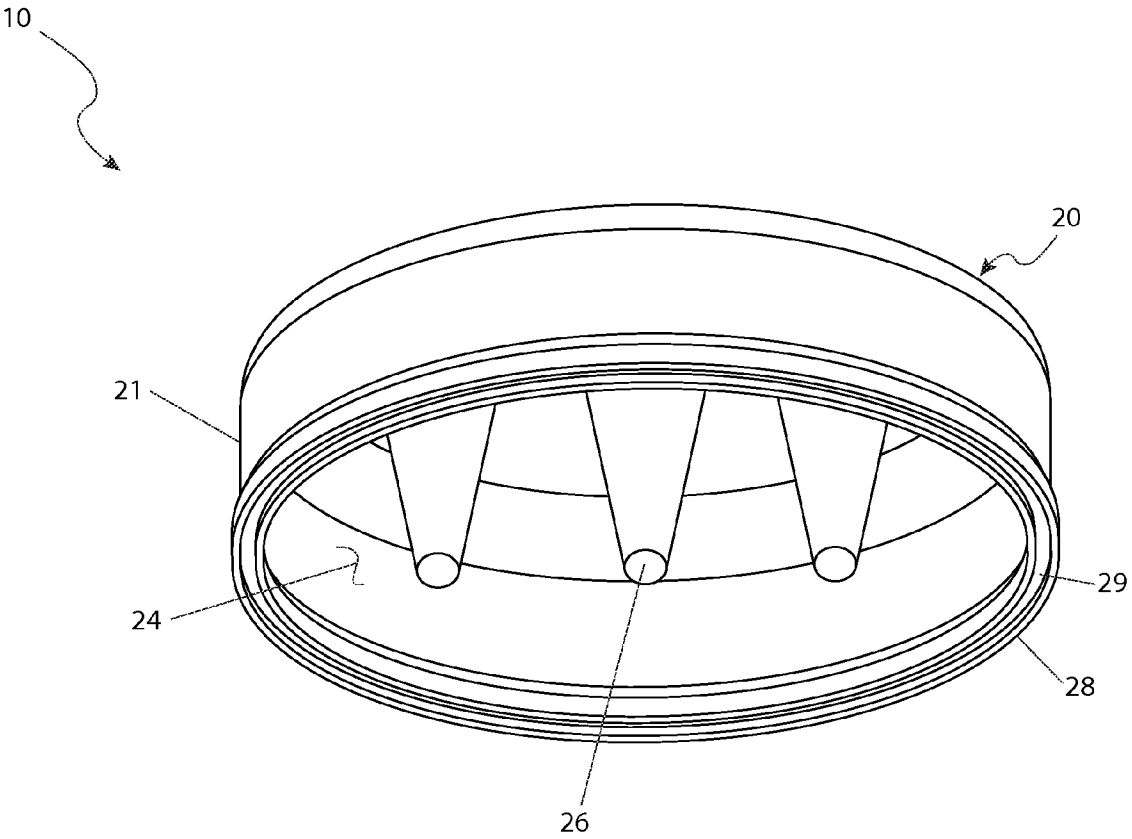
FIG. 2 is a side and bottom perspective view of the disclosed sink overflow hole plug.

Referring now to FIGS. 1 and 2, the device 10 can be made of a rubber or nitrile compound with magnet particles infused throughout the matrix and formed into a unitary piece, such as through in an injection molding process. The magnet particles can be distributed throughout the base material (e.g., rubber) such that the device 10 displays magnetic properties. The purpose of the magnet particles incorporated into the device 10 is an attempt to take advantage of the magnetic field in the eventuality that user's plumbing fixture 100 has an iron or carbon steel substrate layer to aid in attaching and aligning the device 10 to the plumbing fixture 100. Those skilled in the art will appreciate that other materials or processes can be utilized without limiting the scope of the device 10.

The body 20 of the device 10 can include an encircling wall 21 terminating at the top in a diaphragm 22 in such a way as to form (e.g., define) a chamber 24. The body 20 can be configured in any shape, such as an oval shape, a round shape, or any other appropriate shape, without limitation. Disposed upon an interior surface of the diaphragm 22 and extending inwardly inside of the chamber 24 is at least one (1) tapered protuberance 26. For example, the body 20 can include three (3) protuberances 26. The protuberances 26 can be configured to be inserted into and block each external aperture 102 of the overflow prevention channel 101 of the plumbing fixture 100 (FIGS. 3*a* and 3*b*).

The total quantity of protuberances 26 in the body of the device 10 can depend upon the number of external apertures 102 that exist in the plumbing fixture 100. Consequently different embodiments of the device 10 can include a different number of protuberances 26 without limitation. In those embodiments where a plurality of protuberances 26 exist, the protuberances 26 can be positioned to align with the external apertures 102 of the plumbing fixture 100. For example, the protuberances 26 can be positioned uniformly distributed along the centerline of the major axis of the body 20.

Figure 4:
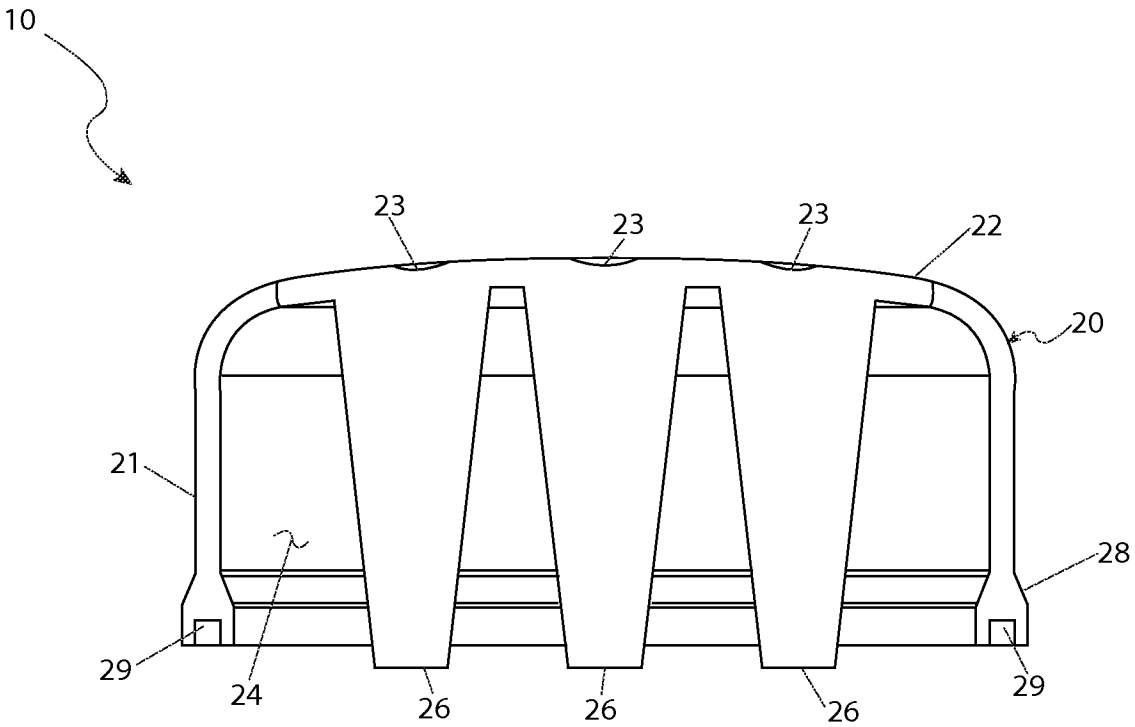

A lip 28 can be circumferentially disposed at the bottom of the encircling wall 21. The lip 28 can include a thickness greater than the thickness of the wall 21. The lip 28 can be connected to or integral to the perimeter edge of the wall 21. A groove 29 can be circumferentially disposed around the lip 28. For example, the groove 29 can be molded within the lip 28 (FIG. 4). The purpose of the groove 29 is an attempt to take advantage of the possibility that a vacuum may be formed in the groove 29 when the device 10 is pressed against the plumbing fixture 100 to aid in attaching and aligning the device 10.

Figure 3A:
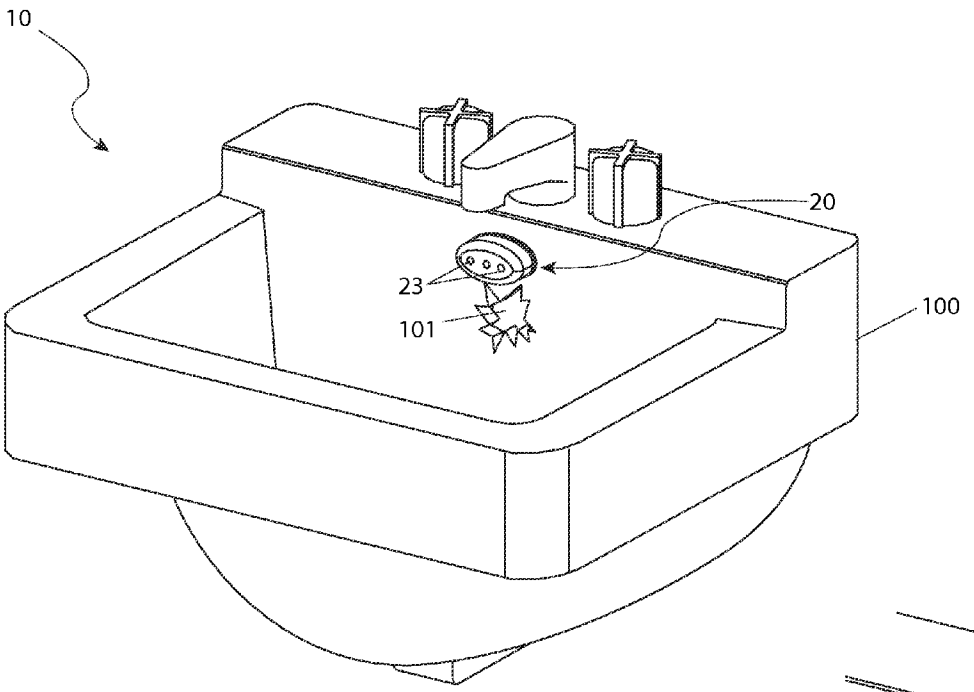
FIG. 3*a* is a perspective view of the disclosed sink overflow hole plug depicted installed to a sink.
Figure 3B:
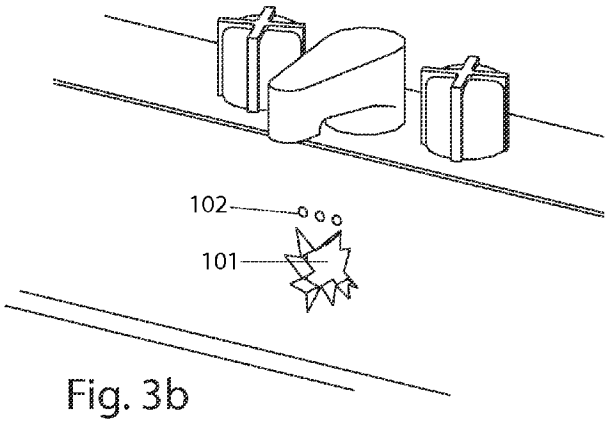
FIG. 3*b* is an enlarged perspective view of a portion of FIG. 3*a* depicting an area around the external apertures of the plumbing fixture with a break away to show the overflow prevention channel: and, FIG. 4 is a section view, taken along a line A-A of FIG. 1, of the disclosed sink overflow hole plug.

Referring to FIGS. 3*a* and 4, molded into the outer face of the diaphragm 22 is an indentation 23 to indicate the location where a user may wish to place a finger to secure the device 10 against the plumbing fixture 100. An indentation 23 can be located on the opposite side of the diaphragm 22 from the protuberance 26.

It is envisioned that other styles and configurations of the disclosed device 10 can be easily incorporated into the teachings of the present disclosure, and only certain particular configurations have been shown and described for purposes of clarity and disclosure and not by way of limitation of scope.

In an example implementation, a user can utilize the example embodiments of the device 10 in a simple and straightforward manner with little or no training. After initial purchase or acquisition of the device 10, it can be installed as indicated in FIGS. 3*a* and 3*b*.

An example method of installing and utilizing the device 10 can be achieved by performing the following steps: acquiring a model of the device 10 having the desired configuration to match the external apertures 102 in the plumbing fixture 100; aligning the protuberance 26 (or protuberances 26 depending upon the configuration of the device 10) in the chamber 24 of the device 10 with the external aperture 102 (or apertures 102) in the plumbing fixture 100; depressing the diaphragm 22 to force the protuberances 26 into the external apertures 102 until the lip 28 comes into contact with the plumbing fixture 100; continuing to depress the diaphragm 22 until the wall 21 of the device 10 buckles and the protuberances 26 are engaged into the external apertures 102 to the extent that an interference fit is established between the protuberances 26 and the external apertures; and continuing to press against the device 10 (e.g., with the fingers of a user's hand engaged into the indentations 23 in the diaphragm 22) while using an opposing hand to use a plunger, or other pressure or vacuum device, to remove material that interferes with the normal functioning of the drainage system.

The foregoing embodiments of the disclosed sink overflow hole plug have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A sink overflow hole plug comprising:

a plug body made from a flexible material and defining an interior chamber, said body comprising:

a continuous sidewall comprising an upper perimeter edge and a lower perimeter edge; and a diaphragm connected to said upper perimeter edge of said sidewall;

a plurality of protuberances, each extending into said chamber; and, a plurality of indentations disposed in an exterior surface of said body, each indentation of said plurality of indentations being aligned with a corresponding protuberance of said plurality of protuberances;

wherein said lower perimeter edge of said sidewall is open to provide access to said chamber; and wherein each protuberance is configured to be received by an external aperture of an overflow prevention channel of a drainage system of a plumbing fixture.

2. The plug of claim 1, wherein said body is magnetic.

3. The plug of claim 1, wherein said flexible material is rubber.

4. The plug of claim 1, wherein said body comprises a lip disposed around said sidewall proximate said lower perimeter edge.

5. The plug of claim 4, wherein said body comprises a groove disposed in said lip.

6. The plug of claim 1, wherein each protuberance extends past said lower perimeter edge of said sidewall.

7. The plug of claim 1, further comprising three protuberances.

8. The plug of claim 1, wherein each protuberance comprises an inwardly tapered shape.

9. A sink overflow hole plug comprising:

a plug body comprising a continuous sidewall comprising an upper perimeter edge and a lower perimeter edge and a diaphragm connected to said upper perimeter edge of said sidewall, said sidewall and said diaphragm defining an interior chamber, said lower perimeter edge of said sidewall being open to provide access to said chamber; and, at least one protuberance extending from an interior surface of said diaphragm into said chamber;

wherein said sidewall and said diaphragm are made from a flexible material;

wherein a plurality of magnetic particles is distributed throughout said flexible material of at least said sidewall; and, wherein said protuberance is configured to be received by an external aperture of an overflow prevention channel of a drainage system of a plumbing fixture.

10. The plug of claim 9, wherein said body comprises a lip disposed circumferentially around said lower perimeter edge of said sidewall.

11. The plug of claim 10, wherein said lip comprises a groove disposed circumferentially around a bottom exterior surface.

12. The plug of claim 11, wherein said body comprises at least one indentation disposed in an exterior surface of said diaphragm, said indentation being aligned with said protuberance.

13. The plug of claim 12, wherein said protuberance comprises an inwardly tapered shape.

14. The plug of claim 13, wherein said protuberance extends past said lower perimeter edge of said sidewall.

* * * * *